US009117582B2

(12) United States Patent
Nakamura

(10) Patent No.: US 9,117,582 B2
(45) Date of Patent: Aug. 25, 2015

(54) MAGNETIC POWDER MATERIAL, LOW-LOSS COMPOSITE MAGNETIC MATERIAL CONTAINING SAME, AND MAGNETIC ELEMENT USING SAME

(75) Inventor: Akihiko Nakamura, Tokyo (JP)

(73) Assignee: SUMIDA CORPORATION, Tokyo (JP)

( * ) Notice: Subject to any disclaimer, the term of this patent is extended or adjusted under 35 U.S.C. 154(b) by 1007 days.

(21) Appl. No.: 13/240,078

(22) Filed: Sep. 22, 2011

(65) Prior Publication Data

US 2012/0194309 A1 Aug. 2, 2012

Related U.S. Application Data

(60) Provisional application No. 61/437,132, filed on Jan. 28, 2011.

(51) Int. Cl.

| | |
|---|---|
| ***H01F 3/08*** | (2006.01) |
| ***H01F 1/37*** | (2006.01) |
| ***B22F 1/00*** | (2006.01) |
| ***H01F 1/153*** | (2006.01) |
| ***H01F 1/26*** | (2006.01) |
| ***H01F 41/02*** | (2006.01) |
| ***C22C 33/02*** | (2006.01) |
| ***C22C 38/34*** | (2006.01) |
| ***C22C 45/02*** | (2006.01) |

(52) U.S. Cl.

CPC ..... *H01F 1/15375* (2013.01); *B22F 1/0007* (2013.01); *C22C 33/0257* (2013.01); *C22C 38/34* (2013.01); *C22C 45/02* (2013.01); *H01F 1/15308* (2013.01); *H01F 1/26* (2013.01); *H01F 41/0246* (2013.01); *B22F 1/0059* (2013.01); *B22F 2999/00* (2013.01)

(58) Field of Classification Search

CPC ..... H01F 1/37; H01F 41/0266; B22F 9/002; C22C 33/02; C22C 33/0257; C22C 45/02

See application file for complete search history.

(56) References Cited

U.S. PATENT DOCUMENTS

2004/0113744 A1 6/2004 Watanabe et al.

FOREIGN PATENT DOCUMENTS

| | | | |
|---|---|---|---|
| CN | 1506983 A | | 6/2004 |
| JP | 2005-294458 | | 10/2005 |
| JP | 2008-106335 | | 5/2008 |
| JP | 2008115404 A | * | 5/2008 |

OTHER PUBLICATIONS

Machine translation of JP2008-115404A, May 2008.*

Extended European Search Report issued in counterpart application No. EP 11190336.5 mailed Feb. 6, 2012 (6 pages).

First Office Action issued May 14, 2014 in counterpart application No. 201210016393.6 from the State Intellectual Property Office of P.R. China with English translation.

* cited by examiner

*Primary Examiner* — Jie Yang
*Assistant Examiner* — Xiaowei Su
(74) *Attorney, Agent, or Firm* — Kratz, Quintos & Hanson, LLP

(57) ABSTRACT

The present invention provides a material which can be used for low pressure molding, and which has a low core loss while maintaining the characteristic of an amorphous powder that is the high coercive force. It provides a magnetic powder material containing, relative to the weight thereof, amorphous powders of 45 to 80 wt %, crystalline powders of 55 to 20 wt %, and a bonding agent. The magnetic powder material contains, relative to the mass thereof, Si of 4.605 to 6.60 mass %, Cr of 2.64 to 3.80 mass %, C of 0.225 to 0.806 mass %, Mn of 0.018 to 0.432 mass %, B of 0.99 to 2.24 mass %, P of equal to or less than 0.0248 mass %, S of equal to or less than 0.0165 mass %, Co of equal to or less than 0.0165 mass %, and a balance of Fe and inevitable impurities.

6 Claims, No Drawings

MAGNETIC POWDER MATERIAL, LOW-LOSS COMPOSITE MAGNETIC MATERIAL CONTAINING SAME, AND MAGNETIC ELEMENT USING SAME

CROSS-REFERENCE TO RELATED APPLICATIONS

The present application claims the benefit of priority to U.S. Application No. 61/437,132, filed Jan. 28, 2011. The content of that application are incorporated herein by reference in their entirety.

BACKGROUND OF THE INVENTION

The present invention relates to a magnetic powder material, a low-loss composite magnetic material containing the magnetic powder material, and a magnetic element using the low-loss composite magnetic material.

BACKGROUND ART

Recently, a demand for power inductors which are usable under large current is increasing together with development of low-voltage power sources. In particular, high-frequency power sources are used for laptop computers, PDAs, and other electronic devices.

Instead of metallic magnetic material powders used so far, ferrite is now often used to produce a variety of choke coils, noise filters and so forth because of its large advantage in costs.

On the other hand, ferrite is not fit for producing such a magnetic element, which has compact in size and usable under the large current, because saturated magnetic flux density of ferrite is too low. Therefore, there is a trend to use metallic magnetic material powders again to produce the core of the magnetic element; because the saturated magnetic flux density of metallic magnetic material is high enough.

As metallic magnetic material powders used for the magnetic element, for example, are Fe powders and alloy powders, such as Fe—Si alloy powders, and Fe—Si—Al alloy powders, of which main component is Fe. In general, since the magnetic element using the metallic magnetic powders has large core loss, a technique to decrease the core loss by mixing alloy powders of amorphous and crystalline is proposed (see Patent Document 1, referred to as a "prior art 1").

Moreover, another technique is also proposed by adding alloy powders of crystallize into alloy powders of amorphous, to increase the filling ratio of these metal powders into a mold to improve the magnetic permeability and the strength of the produced magnetic element (see Patent Document 2, referred to as a "prior art 2").

[Patent Document 1] JP 2007-134381A

[Patent Document 2] JP 2010-118486A

SUMMARY OF THE INVENTION

The technique disclosed in the prior art 1 has an advantage that the core loss is reduced by using two kinds of alloy powders with different crystalline properties and an insulating binder.

When the production of a dust core is raised as a sample, core loss generated by the raw material of the dust core, substantially 80 to 90% is caused by hysteresis loss. Such hysteresis loss can be improved by using amorphous powders having small coercivity.

In general, magnetic elements made of alloy powders are produced by mixing the metallic powders with a binder at a normal temperature to perform pressure molding. However when amorphous powders are used as the alloy powders, it needs a high molding pressure to obtain a predetermined density of the molded object because amorphous alloy powders are too hard to make plastic deformation. Furthermore, there is a problem that the high molding pressure for the amorphous powders may cause large core loss when the molding is performed.

Therefore, there is a social demand for a low-loss magnetic material which can utilize the low coercivity characteristics of amorphous powders, and at the same time, be subjected to low pressure molding.

The present invention has been made in view of the above-explained situation, and the object of the present invention is to provide a magnetic powder material which has good electrical properties and can improve the productivity of a magnetic element, a low-loss composite magnetic material containing the magnetic powder material, and a magnetic element using the low-loss composite magnetic material.

That is, the first aspect of the present invention provides a magnetic powder material containing, from 45 to 80 wt % of amorphous powders and from 55 to 20 wt % of crystalline powders to the weight of the magnetic powder material. It is preferable that the magnetic powder material should contain 45 to 55 wt % of the amorphous powders and 55 to 45 wt % of the crystalline powders to the weight of the magnetic powder material.

The magnetic powder material of the present invention contains: Si of 4.605 to 6.60 mass %; Cr of 2.64 to 3.80 mass %; C of 0.225 to 0.806 mass %; Mn of 0.018 to 0.432 mass %; B of 0.99 to 2.24 mass %; P of equal to or less than 0.0248 mass %; S of equal to or less than 0.0165 mass %; Co of equal to or less than 0.0165 mass %; and a balance of Fe and inevitable impurities to a mass of the magnetic powder material.

According to the magnetic powder material of the present invention, the amorphous powders contain: Si of not less than 6.2 mass % but not more than 7.2 mass %; Cr of not less than 2.3 mass % but not more than 2.7 mass %; C of not less than 0.5 mass % but not more than 1.0 mass %; Mn of not less than 0.04 mass % but not more than 0.49 mass %; B of not less than 2.2 mass % but not more than 2.8 mass %; and a balance of Fe and inevitable impurities to the mass of the magnetic powder material; the crystalline powders contain: Si of not less than 3.3 mass % but not more than 4.2 mass %; Cr of not less than 4.0 mass % but not more than 4.7 mass %; C of equal to or less than 0.03 mass %; Mn of equal to or less than 0.20 mass %; P of equal to or less than 0.045 mass %; S of equal to or less than 0.03 mass %; Co of equal to or less than 0.03 mass %; and a balance of Fe and inevitable impurities to the mass of the magnetic powder material.

An average particle size ($D_{50A}$) of the amorphous powders is smaller than 45 μm, an average particle size ($D_{50C}$) of the crystalline powders is smaller than 13 μm, and a ratio $D_{50A}/D_{50C}$ is not less than 2.18.

The second aspect of the present invention provides a composite magnetic material containing a bonding agent and the above-explained magnetic powder material in the pressure molding. Here the bonding agent can be a thermosetting resin selected from the group consisting of an epoxy type resin, a silicone type resin and a phenol type resin. It is preferable that the content of the bonding agent is 2.0 to 4.0 wt % to the weight of the magnetic powder material. A core of the composite magnetic material molded by compression has a core loss not larger than 1400 kw/m$^3$ and a relative permeability exceeds 20, when it is measured under the condition that a magnetic flux density is 50 mT and an effective frequency is 250 kHz.

The third aspect of the present invention provides a magnetic element produced by using the above-explained composite magnetic material. The magnetic element can be, for example, a metal composite inductor.

According to the present invention, the composite magnetic powder having an excellent property can be produced. By using the composite magnetic powder, the magnetic element with low core loss, which can be molded in low pressure, can be obtained.

DETAILED DESCRIPTION

The present invention will be explained in more detail below.

The magnetic powder material of the present invention contains from 45 to 80 wt % of an amorphous powders and from 55 to 20 wt % of a crystalline powders to the weight of the magnetic powder material. It is preferable that the magnetic powder material contains 45 to 55 wt % of the amorphous powders and 55 to 45 wt % of the crystalline powders to the weight of the magnetic powder material.

If the amount of the amorphous powders in the alloy is less than 45 wt % and that of the crystalline powders exceeds 55 wt %, the improvement of the core loss is insufficient. The case that the amount of the crystalline powders in the alloy is less than 20 wt % and that of the amorphous powders exceeds 80 wt % is also the same.

It is preferable that the magnetic powder material contains silicon (Si), chrome (Cr), carbon (C), manganese (Mn), boron (B), phosphorous (P), sulfur (S), and cobalt (Co) at predetermined compounding ratios, respectively, and also contains a balance of Fe and inevitable impurities. More specifically, it is preferable that the magnetic powder material contains 4.605 to 6.60 mass % of Si, 2.64 to 3.80 mass % of Cr, 0.225 to 0.806 mass % of C, 0.018 to 0.432 mass % of Mn, 0.99 to 2.24 mass % of B, P of not more than 0.0248 mass %, S of not more than 0.0165 mass %, Co of not more than 0.0165 mass % to the mass of the magnetic powder material, a balance of Fe and inevitable impurities.

In general, C is an impurity in crystalline powders. However, since it is an essential element in amorphous powders, it is preferable that the C content in the magnetic powder material of the present invention is from 0.225 to 0.806 mass %. When the C content in composite magnetic powders is less than 0.225 mass %, amorphous powders cannot be obtained, and when the C content exceeds 0.806 mass %, the composite magnetic powders have high coercivity and deteriorated core loss.

Moreover, it is preferable that the amorphous powders used for the magnetic powder material contain silicon (Si), chrome (Cr), carbon (C), manganese (Mn), and boron (B) at predetermined compounding ratios, respectively, and contain a balance of Fe and inevitable impurities. More specifically, it is preferable that the amorphous powders contain not less than 6.2 mass % but not more than 7.2 mass % of Si, not less than 2.3 mass % but not more than 2.7 mass % of Cr, not less than 0.5 mass % but not more than 1.0 mass % of C, not less than 0.04 mass % but not more than 0.49 mass % of Mn, not less than 2.2 mass % but not more than 2.8 mass % of B to the weight of the magnetic powder material, and Fe and inevitable impurities as a balance.

It is preferable that the crystalline powders contain Si, Cr, C, Mn, P, S, and Co at predetermined compounding ratios, respectively, and contain Fe and inevitable impurities as the balance. More specifically, it is preferable that the crystalline powders contain not less than 3.3 mass % but not more than 4.2 mass % of Si, not less than 4.0 mass % but not more than 4.7 mass % of Cr, not more than 0.03 mass % of C, not more than 0.20 mass % of Mn, not more than 0.045 mass % P, not more than 0.03 mass % S, not more than 0.03 mass % Co to the mass of the magnetic powder material, and Fe and inevitable impurities as the balance.

The crystalline powders used for production of the magnetic powder material may be produced through a method such as water atomizing, gas atomizing, centrifugal atomizing, and so forth. Among them, for example, water atomizing is a technique to obtain the crystalline powders by spraying high-pressure water to the melted metal flew out from an open hole at the bottom of a tundish.

Moreover, the amorphous powders may be produced through super rapid-cooling atomizing which is a combination of water atomizing and gas atomizing and has a cooling speed of $10^6$ K/s.

It is preferable that the average particle size ($D_{50A}$) of the amorphous powders is less than 45 μm, and the average particle size ($D_{50C}$) of the crystalline powders is less than 13 μm, and the ratio of $D_{50A}/D_{50C}$ is not less than 2.18. When $D_{50A}$ exceeds 45 μm and $D_{50C}$ exceeds 13 μm, the core loss is not improved even if the ratio of $D_{50A}/D_{50C}$ is not less than 2.18. Moreover, even if the average particle size ($D_{50A}$) of the amorphous powders is not more than 45 μm and the average particle size ($D_{50C}$) of the crystalline powders is not more than 13 μm, the core loss is not improved when the ratio of $D_{50A}/D_{50C}$ is less than 2.18.

It is preferable that respective average particle sizes of the amorphous powders and the crystalline powders are measured by a laser diffraction-scattering grain size distribution measuring apparatus. For highly accurate measurement, it is preferable to use, for example, LA-920 (made by HORIBA, Ltd.,) as the measuring apparatus.

It is preferable that the bonding agent used for the composite magnetic material of the present invention is a thermosetting resin such as an epoxy-type resin, a silicone-type resin, and a phenol-type resin. Among them, it is preferable to use the silicone-type resin, because it has a relatively high heat resistance temperature.

It is preferable that the content of the bonding agent mixed with the composite magnetic powders is from 2.0 to 4.0 wt % to the weight of the magnetic powder material. If the content is less than 2.0 wt %, the strength of the formed object is insufficient, and if the content exceeds 4.0 wt %, the relative magnetic permeability target cannot be achieved.

The magnetic element of the present invention is produced as follows.

The amorphous powders prepared through super rapid-cooling atomizing, and the crystalline powders prepared through water atomizing are weighted separately and mixed so as to let the amorphous powders to be 45 to 80 wt %, and the crystalline powders to be 55 to 20 wt % relative to the weight of the mixed magnetic powder material.

Next, the powders obtained are sprayed with the thermosetting resin to obtain the resin coated composite magnetic powders.

The composite magnetic material obtained as mentioned above is subjected to pressure molding to obtain a ring core. Next, the obtained formed object is heated for from 30 minutes to 1.5 hours at a temperature of 150 to 250° C. to set the bonding agent; thereby a dust core is obtained. In the magnetic element, coil-shaped copper wires are molded into the composite magnetic material.

EXAMPLES

The present invention will be explained in more detail by using the following examples, but the present invention is not limited to them.

Example 1

Studying for Containing Amount of C

(1) Preparation of Magnetic Powder Material

Respective constituents of the amorphous powders and the crystalline powders used in this example are shown in table 1 below. The amorphous powders having the composition shown in table 1 were prepared through super rapid-cooling atomizing. The crystalline powders shown in table 1 were prepared through water atomizing.

First, metal powders obtained as mentioned above were dispersed by an ultrasonic dispersion apparatus by using MeOH as a dispersion medium. Thereafter, average particle size of those samples were measured by a laser diffraction-scattering grain size distribution measuring apparatus, LA-920 (HORIBA Ltd.) to obtain the average particle size ($D_{50}$). This measuring apparatus was set to determine an average size from the length of the longest axis and the length of the shortest axis of a sample powder as the particle size, when a given powder sample was not truly spherical.

TABLE 1

| Metal Constituent | Content (mass %) Amorphous Powders | Crystalline Powders | Mixed Powders |
|---|---|---|---|
| Si | 6.2 to 7.2 | 3.3 to 4.2 | 4.605 to 6.60 |
| Cr | 2.3 to 2.7 | 4.0 to 4.7 | 2.64 to 3.80 |
| C | 0.5 to 1.0 | Max 0.03 | 0.255 to 0.806 |
| Mn | 0.04 to 0.49 | Max 0.20 | 0.018 to 0.432 |
| P | — | Max 0.045 | Max 0.0248 |
| S | — | Max 0.03 | Max 0.0165 |
| Co | — | Max 0.03 | Max 0.0165 |
| B | 2.2 to 2.8 | — | 0.99 to 2.24 |
| Fe | Balance | Balance | Balance |

(2) Preparation of Mixed Powder

The above-explained amorphous powders (C: 0.5 to 1.0 mass %) and crystalline powders (C: Max 0.03 mass %) were mixed at a ratio shown in the following table 2 to obtain mixed powders of Comparative samples 1 to 3 and the sample 1 to 4 of the present invention.

Next, a silicone-type resin, the bonding agent, was sprayed to the obtained alloy powders; thereby a silicone-type resin coated composite magnetic material is obtained.

By using the composite magnetic material obtained as explained, under the following conditions, the formed object (a ring core) is obtained to measure the relative magnetic permeability and a core loss (Pcv).

<Molding Conditions>

Molding method: compression molding

Molded object shape: ring core

Molded object size: outer diameter 15 mm, inner diameter 10 mm, and thickness 2.5 mm Molding Pressure: Comparative sample=2 to 4 ton/cm$^2$ Present invention sample=2 ton/cm$^2$ The samples having the same space factor were obtained by molding under the pressure of 2 ton/cm$^2$ for Comparative samples 1 and 2, and 4 ton/cm$^2$ for Comparative sample 3 with the present invention samples.

Next, heat the samples obtained respectively for one hour at 200° C. in the air to set the bonding agent, and the ring cores (the dust cores) were obtained.

(3) Studying for Physicality of Powder Magnetic Core

As the magnetic properties, relative magnetic permeability and core losses (Pcv (kw/m$^3$)) of the dust cores produced using the composite magnetic materials of the present invention samples 1 to 4 and Comparative samples 1 to 3 were measured to evaluate. Respective measurement conditions of the magnetic properties and evaluation criterion thereof were explained below.

(a) Relative Magnetic Permeability: an inductance at a frequency of 1 MHz was measured using the impedance analyzer 4294A made by Agilent, and then the relative magnetic permeability was obtained based on core constant. The relative magnetic permeability ($\mu_r$) was obtained from a following equation.

$$(\mu_r)=(Ls*1e)/(\mu_0*Ae*N^2)$$

Wherein, Ls is the inductance (H), 1e is a magnetic path length (m), Ae is a cross-sectional area (m$^2$), $\mu_0$ is a magnetic permeability in a vacuum ($4\pi*10^{-7}$ (H/m)), and N is the number of windings of the coil.

(b) Core loss (Pcv: w/m$^3$): by using the ring cores produced as explained above, core losses of them were measured under the conditions Bm=50 mT and f (effective frequency)=250 kHz using B—H analyzer SY8232 made by IWATSU Electronic Co., Ltd.

From the two standpoints of securing the inductance of a product and of improvement of the circuit efficiency, the

TABLE 2

| | | Blend ratio of powders (wt %) Amorphous | Crystalline | Content of C (mass %) | Relative magnetic permeability μ | Pcv (kw/m$^3$) @250 kHz, 50 mT | Result |
|---|---|---|---|---|---|---|---|
| Comparative sample 1 | | 0 | 100 | 0.01 | 23.0 | 2,000 | Poor |
| Comparative sample 2 | | 40 | 60 | 0.21 | 22.5 | 1,500 | Poor |
| Samples of present invention | 1 | 45 | 55 | 0.23 | 22.0 | 1,400 | Good |
| | 2 | 50 | 50 | 0.30 | 22.8 | 1,250 | Good |
| | 3 | 55 | 45 | 0.40 | 22.5 | 1,260 | Good |
| | 4 | 80 | 20 | 0.79 | 21.1 | 1,350 | Good |
| Comparative sample 3 | | 85 | 15 | 0.81 | 20.0 | 1,500 | Poor |
| Property value to be achieved | | — | — | 0.225 to 0.806 | Not less than 20 | Not more than 1,400 | — |

relative magnetic permeability was set to be not less than 20 and the core loss was set to not larger than 1,400 kw/m$^3$ (see table 2).

The relative magnetic permeability of the dust cores of Comparative samples 1 to 3 accomplished the target value. However, their Pcv values were too high to reach the target value. Moreover, the core loss of the dust core of the Comparative sample 2 did not satisfy the target value, because of too little blend ratio of the amorphous powder. Accordingly, it is determined that the blend ratio of the amorphous powder is insufficient, if it is not more than 40 wt %.

On the other hand, molding pressure of the dust core of Comparative sample 3 is high because of a too high blend ratio of the amorphous powders. By this, the core loss of it cannot satisfy the target value. Accordingly, it is determined that the blend ratio of the amorphous powders is excess, if it is not less than 85 wt %.

As mentioned above, the core loss of the dust cores is sufficiently decreased when the content of C is from 0.225 mass % to 0.80 mass %.

Example 2

Studying for Particle Size Ratio and Relationship between Powder Particle Size and Target Properties The amorphous powders ($D_{50A}$=24 μm) and the crystalline powders ($D_{50C}$=7 μm), were respectively mixed together so as that their ration were 50/50 (w/w). Then, the dust cores shown in table 3 below were produced through the same fashion as that of the example 1.

The relative magnetic permeability and core losses of the dust cores obtained were measured by using the same method as that of the example 1, and were studied the change of these properties depending on a particle size. The results are shown in table 3.

TABLE 3

| | Particle size ($D_{50}$) | | Particle size ratio | Relative magnetic | Pcv (kw/m$^3$) | |
|---|---|---|---|---|---|---|
| | Amorphous | Crystalline | ($D_{50A}/D_{50C}$) | permeability μ | @250 kHz, 50 mT | Result |
| Comparative sample 4 | 45 | 13 | 3.46 | 21.7 | 2100 | Poor |
| Comparative sample 5 | 24 | 13 | 1.85 | 20.0 | 2200 | Poor |
| Samples of 5 | 24 | 11 | 2.18 | 21.5 | 1390 | Good |
| present 6 | 24 | 9 | 2.67 | 22.5 | 1290 | Good |
| invention 7 | 24 | 7 | 3.43 | 22.8 | 1250 | Good |
| Property value to be achieved | — | — | | Not less than 20 | Not more than 1,400 | — |

According to Comparative sample 4 using larger particles, the particle size of the amorphous powders was 45 μm, and that of crystalline powders was 13 μm, the particle size ratio was enough high, 3.46, but the core loss of this sample did not reach the target value. Moreover, according to Comparative sample 5 in which the particle size of the amorphous powders was 24 μm, the particle size ratio was less than 2, and the core loss of them did not reach the target value as the same as Comparative sample 4.

Comparative sample 4 and the present sample 7 had substantially same particle size ratio, but their core losses (Pcv value) were very different. That is, in the present sample 7, a decreased eddy current that is current flowed through the inside of the particle caused the lower core losses, because the powders having smaller particle sizes (amorphous: 24 μm, and crystalline: 7 μm) than those (amorphous: 45 μm, and crystalline: 13 μm) of the powders used in Comparative sample 4, were used.

As mentioned above, the particle size of the powders used largely affects the reduction of eddy current. The core loss is sufficiently reduced when the average particle size of the amorphous powders is less than 45 μm, and that of the crystalline powders is less than 13 μm.

Moreover, when Comparative samples 5, the present sample 5, 6, and 7 were compared, the smaller the particle size of the crystalline powders became, the more Pcv decreased. In particular, Pcv value differences between Comparative sample 5 and the present sample 5 is large, and this suggests that the particle size ratio between the amorphous powders and the crystalline powders largely affects the core loss. When the particle size ratio between those two kinds of powders became large, crystalline powder particles can easily fill the spaces among the amorphous powder particles, thereby enabling a low pressure molding. This brings about the reduction of the core loss.

As mentioned above, when the particle size ratio of the amorphous powders to the crystalline powders is not less than 2.18, sufficient reduction of the core loss is observed.

In general, when the amorphous powders are solely used, it is possible to produce the dust core with little core loss. However, since the amorphous powders are hard, it is necessary to apply a high pressure like 20 ton/cm$^2$ to solidify them. Moreover, when the amorphous powders are used, for removing a stress at molding to recover the properties, a thermal treatment at a temperature of substantially 450° C. is necessary.

In contrast, when the two kinds of alloy powders: amorphous powders; and crystalline powders, are used and the particle size ratio therebetween is set to be equal to or larger than 2.18. It makes possible to form by applying a low molding pressure of about 2 ton/cm$^2$. And this pressure is the same level as that used in the case that crystalline powders were solely used. Moreover, since a low pressure molding is enabled, the stress generated in the process of molding becomes smaller, and this makes possible to manufacture low-loss magnetic elements, even if they are not under heat treatment for removing the molding stress.

The present invention is useful for making a PDA and other electronic devices compact in size, lightweight, and advanced in performance.

What is claimed is:

1. A magnetic powder material comprising, relative to a weight of the magnetic powder material, amorphous powders in an amount from 45 to 80 wt % and crystalline powders in an amount from 55 to 20 wt %, wherein the amorphous powders comprise, relative to the mass of the magnetic powder material:

Si of not less than 6.2 mass % but not more than 7.2 mass %;

Cr of not less than 2.3 mass % but not more than 2.7 mass %;

C of not less than 0.5 mass % but not more than 1.0 mass %;

Mn of not less than 0.04 mass % but not more than 0.49 mass %;

B of not less than 2.2 mass % but not more than 2.8 mass %; and a balance of Fe and inevitable impurities, and the crystalline powders comprise, relative to the mass of the magnetic powder material:

Si of not less than 3.3 mass % but not more than 4.2 mass %;

Cr of not less than 4.0 mass % but not more than 4.7 mass %;

C of equal to or less than 0.03 mass %;

Mn of equal to or less than 0.20 mass %;

P of equal to or less than 0.045 mass %;

S of equal to or less than 0.03 mass %,

Co of equal to or less than 0.03 mass %; and a balance of Fe and inevitable impurities.

2. The magnetic powder material according to claim 1, wherein an average particle size ($D_{50A}$) of the amorphous powders is equal to or smaller than 45 μm, an average particle size ($D_{50}$) of the crystalline powders is equal to or smaller than 13 μm, and a ratio of the average particle size $D_{50A}$ of the amorphous powders over the average particle size $D_{50C}$ of the crystalline powders is equal to or higher than 2.18.

3. A composite magnetic material comprising a bonding agent and the magnetic powder material according to claim 1, the bonding agent being a resin selected from a following group: a silicone-based resin; and a phenol-based resin.

4. The composite magnetic material according to claim 3, wherein, when the composite magnetic material is compressed and formed, core loss is equal to or smaller than 1400 kw/$m^3$ and a relative magnetic permeability exceeds 20 when measured at a condition in which a magnetic flux density is 50 mT and an effective frequency is 250 kHz.

5. A magnetic element produced using the composite magnetic material according to claim 4.

6. The magnetic element according to claim 5, wherein the magnetic element is a metal composite inductor.

* * * * *